US010703103B2

(12) United States Patent
Takeuchi et al.

(10) Patent No.: US 10,703,103 B2
(45) Date of Patent: Jul. 7, 2020

(54) LIQUID EJECTION HEAD AND MANUFACTURING METHOD THEREOF

(71) Applicant: CANON KABUSHIKI KAISHA, Tokyo (JP)

(72) Inventors: Souta Takeuchi, Fujisawa (JP); Soichiro Nagamochi, Kawasaki (JP); Takuya Hatsui, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/239,863

(22) Filed: Jan. 4, 2019

(65) Prior Publication Data

US 2019/0217619 A1 Jul. 18, 2019

(30) Foreign Application Priority Data

Jan. 17, 2018 (JP) ..... 2018-005760

(51) Int. Cl.
*B41J 2/16* (2006.01)
*B41J 2/14* (2006.01)

(52) U.S. Cl.
CPC ..... *B41J 2/1629* (2013.01); *B41J 2/1404* (2013.01); *B41J 2/14233* (2013.01); *B41J 2/161* (2013.01); *B41J 2/1603* (2013.01); *B41J 2/1639* (2013.01); *B41J 2/1642* (2013.01); *B41J 2/1645* (2013.01); *B41J 2002/14403* (2013.01)

(58) Field of Classification Search
CPC .... B41J 2/1404; B41J 2/14233; B41J 2/1603; B41J 2/161; B41J 2/1639; B41J 2/1642; B41J 2/1645; B41J 2/1629
See application file for complete search history.

(56) References Cited

U.S. PATENT DOCUMENTS 6,139,761 A 10/2000 Ohkuma
7,828,419 B2 11/2010 Ikegame et al.
2004/0263595 A1* 12/2004 Keenan ..... B41J 2/14145 347/93

FOREIGN PATENT DOCUMENTS

JP 3343875 B2 11/2002
JP 5171002 B2 3/2013

* cited by examiner

*Primary Examiner* — Lamson D Nguyen
(74) *Attorney, Agent, or Firm* — Venable LLP

(57) ABSTRACT

A liquid ejection head including a substrate, an energy generating element provided on the substrate, a film provided on the substrate and the energy generating element, and a flow path forming member provided on the substrate, forming a flow path of a liquid between the flow path forming member and the substrate, and having an ejection orifice at a position faced with the energy generating element, characterized in that the substrate has a supply path of the liquid communicating with the flow path, the flow path forming member has a structure protruding toward the supply path, and a peripheral shape of a distal end portion of the structure is a curved surface shape.

8 Claims, 8 Drawing Sheets

LIQUID EJECTION HEAD AND MANUFACTURING METHOD THEREOF

BACKGROUND OF THE INVENTION

Field of the Invention

The Present invention relates to a liquid ejection head and a manufacturing method thereof.

Description of the Related Art

A recording apparatus such as an ink jet recording apparatus which performs recording by ejecting a liquid has a liquid ejection head for ejecting a liquid. The liquid ejection head generally has a substrate, an energy generating element which is provided on the substrate and generates energy for ejecting the liquid, and a flow path forming member in which a flow path of a liquid and an ejection orifice for ejecting the liquid are formed and constituted by an organic material such as a resin. As the manufacturing method of the liquid ejection head, methods described in Japanese Patent No. 3343875 and Japanese Patent No. 5171002 are cited, for example.

In the method described in Japanese Patent No. 3343875 and Japanese Patent No. 5171002, a supply path for a liquid communicating with the flow path and penetrating a silicon substrate is formed by wet-etching the silicon substrate. In the wet-etching, a silicon oxide film or a silicon nitride film formed on a surface of the silicon substrate is used as an etching stop layer. An etching stop layer (a silicon oxide film or a silicon nitride film) remaining between the flow path and the supply path after the etching is generally called a membrane film. The membrane film is generally supported by a mold material of the flow path as illustrated in Japanese Patent No. 3343875 or is supported by a beam-shaped or a rib-shaped protrusion extending from a flow-path forming member to the supply path and having a peripheral shape of a distal end portion having a corner part as illustrated in Japanese Patent No. 5171002.

SUMMARY OF THE INVENTION

The liquid ejection head according to the present invention is a liquid ejection head including a substrate; an energy generating element provided on the substrate; a film provided on the substrate and the energy generating element; and a flow path forming member provided on the substrate, forming a flow path of a liquid between the flow path forming member and the substrate and having an ejection orifice at a position faced with the energy generating element, characterized in that the substrate has a supply path for a liquid communicating with the flow path; the flow path forming member has a structure protruding toward the supply path; and a peripheral shape of a distal end portion of the structure is a curved surface shape.

A manufacturing method of the liquid ejection head according to the present invention includes: a step of forming the film on the substrate on which the energy generating element is provided; a step of forming a mold material of the flow path on the film; a step of forming a resin layer which is to be turned into the flow path forming member having the structure on the film and the mold material; a step of forming the ejection orifice on the resin layer; a step of etching the substrate from a surface on a side opposite to a surface on which the film is formed by using the film as an etching stop layer; a step of removing the film present between an opening portion formed by the etching and the mold material along with the resin layer to form the supply path; and a step of removing the mold material to form the flow path forming member having the flow path and the structure.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

As a material of a mold material of a flow path, a material softened by heating such as polymethylisopropenylketone is usually used and thus, in wet-etching, the mold material is softened by heating. Thus, even if the mold material is in contact with a membrane film, a force applied on the membrane film cannot be sufficiently supported. Therefore, a structure supporting the membrane film at a stage when the wet-etching is finished is only a protrusion extending from a flow path forming member to a supply path.

However, if the membrane film is supported only by the protrusion, the membrane film is deformed by a film stress of itself, and a crack can occur in some cases. If a crack occurs in the membrane film, it gives damage on other structures in subsequent manufacturing processes, and reliability of the liquid ejection head may be lowered in some cases. On the other hand, if a protrusion extending from the flow path forming member to the supply path is simply enlarged in order to suppress occurrence of a crack in the membrane film, a supply path opening portion of the liquid is closed, and an area of the supply path opening portion cannot be ensured sufficiently.

The present invention has an object to provide a liquid ejection head which is highly reliable and has an area for the supply path opening portion sufficiently ensured.

[Liquid Ejection Head]

The liquid ejection head according to the present invention includes a substrate, an energy generating element, a film, and a flow path forming member. The energy generating element is provided on the substrate. The film is provided on the substrate and the energy generating element. The flow path forming member is provided on the substrate and forms a flow path of a liquid between the flow path forming member and the substrate and has an ejection orifice at a position faced with the energy generating element. Moreover, the substrate has a supply path of the liquid communicating with the flow path. Here, the flow path forming member has a structure protruding from a surface in contact with the flow path and faced with the substrate toward the supply path, and a peripheral shape of a distal end portion of the structure is a curved surface shape.

Figure 6:
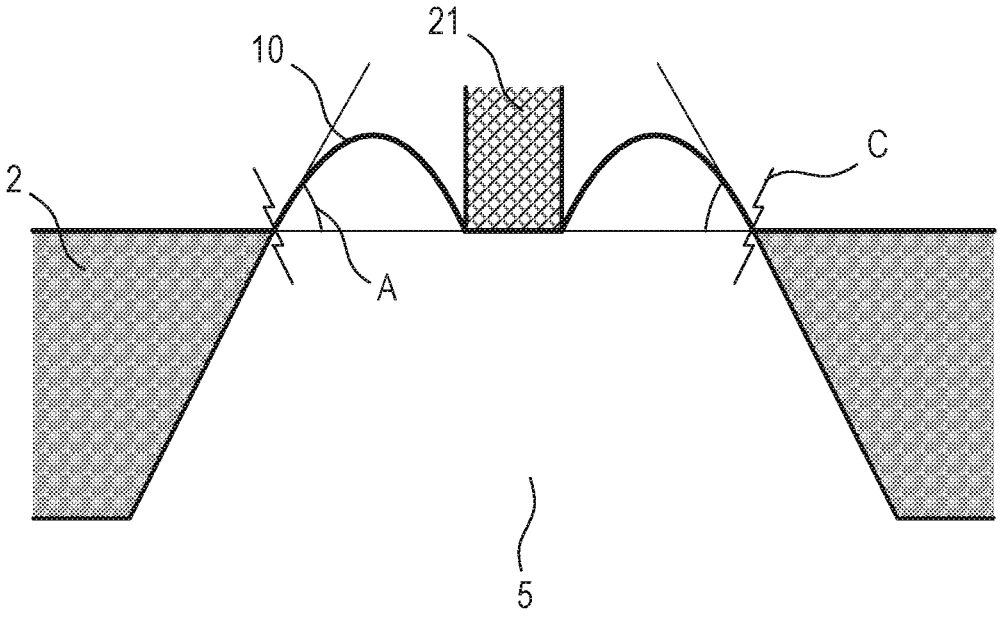
FIG. 6 is a sectional view illustrating the bending angle of the film in a conventional ink jet recording head.

The inventors have examined an occurrence mechanism of the aforementioned crack in the membrane film and found that when a bending angle A of the membrane film 10 becomes larger and reaches a limit bending angle, it results in a crack C of the membrane film 10 as illustrated in FIG. 6. In order to prevent the bending angle A of the membrane film 10 from reaching the limit bending angle, the protrusion extending from the flow path forming member to the supply path can be simply made larger, but an area of the supply path opening portion of the liquid cannot be ensured, and the liquid cannot be sufficiently supplied to the flow path.

Figure 4:
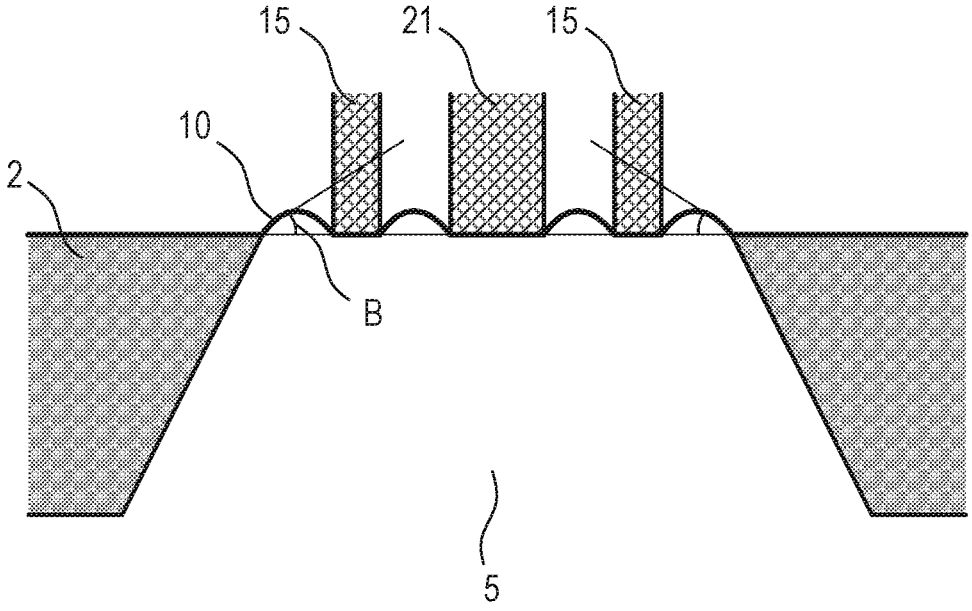
FIG. 4 is a sectional view illustrating a bending angle of the film in an example of the ink jet recording head according to this embodiment.

The inventors have found that, by providing a structure protruding from a surface in contact with the flow path and faced with the substrate toward the supply path and having a curved-surface shaped peripheral shape of the distal end portion on the flow path forming member, the area of the supply path opening portion can be sufficiently ensured while occurrence of a crack in the membrane film is suppressed. As illustrated in FIG. 4, since a bending angle B of the membrane film 10 can be reduced by the presence of the structure 15 according to the present invention, the bending angle B can be prevented from reaching the limit bending angle. Moreover, since the peripheral shape of the distal end portion of the structure is a curved surface shape and does not have a corner part, even when the membrane film is bent/deformed, occurrence of stress concentration on the corner part can be suppressed, and a crack in the membrane film can be suppressed. Moreover, since the peripheral shape of the distal end portion of the structure is a curved surface shape, even if an area of a section on a surface substantially in parallel with the substrate on the distal end portion of the structure is small, a crack in the membrane film can be suppressed, and the area of the supply path opening portion can be sufficiently ensured.

The liquid ejection head according to embodiments of the present invention will be described below by referring to the drawings. In each of the following embodiments, specific constitution will be described for an ink jet recording head which ejects ink as a liquid, which is an embodiment of the present invention, but the present invention is not limited to them. The liquid ejection head according to the present invention can be applied to apparatuses such as a printer, a copier, a facsimile machine having a communication system, a word processor having a printer portion and the like and moreover to an industrial recording apparatus combined with various processing devices in a complex manner. It can be used in applications such as a biochip manufacture and an electronic circuit printing, for example. Moreover, since the embodiments described below are appropriate specific examples of the present invention, technically suitable various limitations are given. However, this embodiment is not limited to the embodiment of the present description or other specific methods as long as it follows an idea of the present invention.

Figure 1:
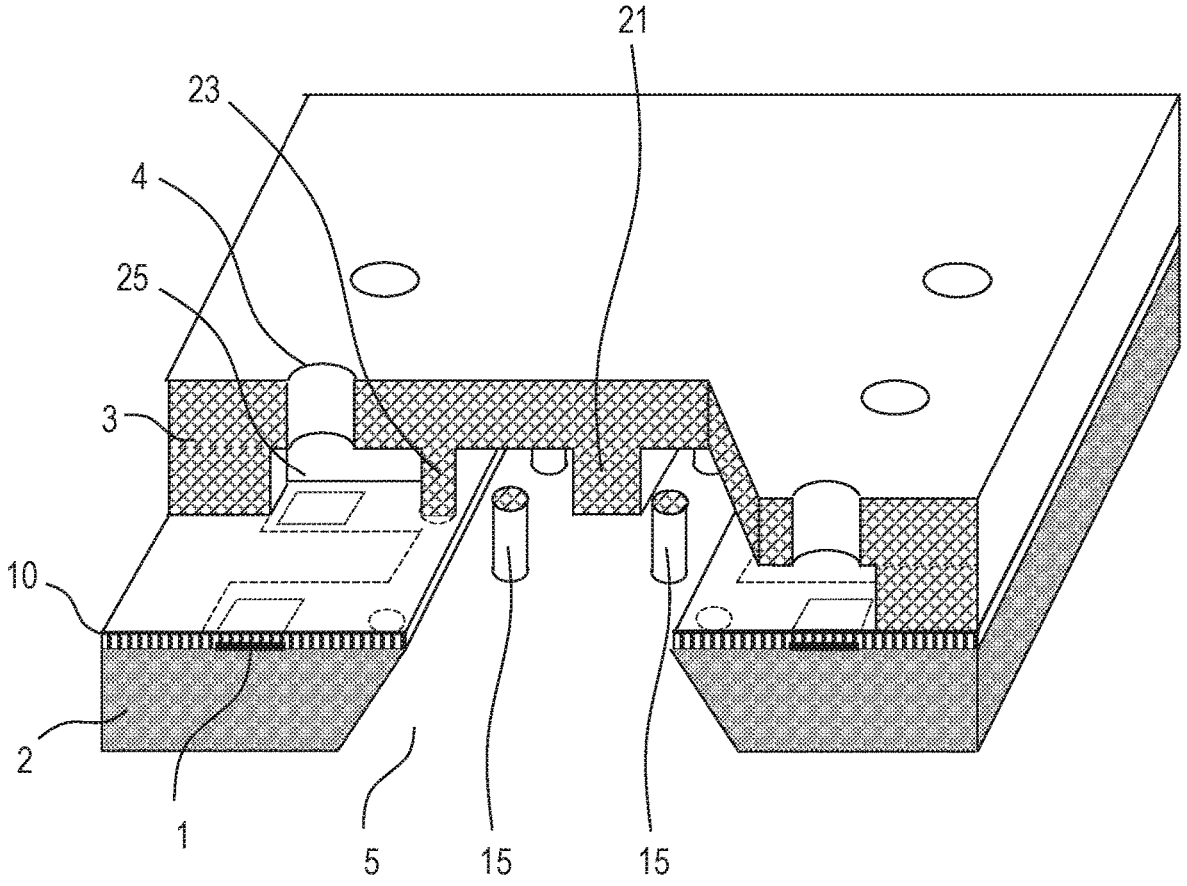
FIG. 1 is a perspective sectional view illustrating an example of an ink jet recording head according to this embodiment.
Figure 2:
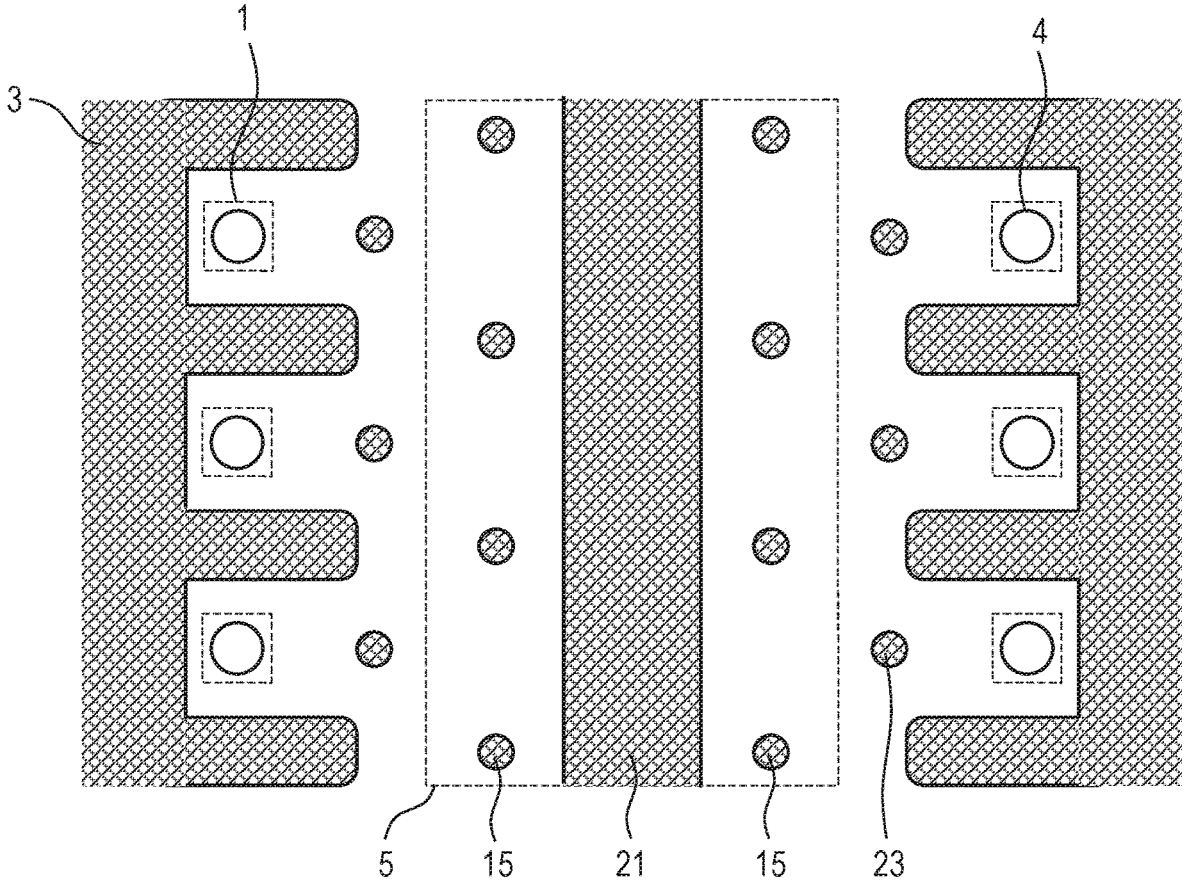
FIG. 2 is a plan view illustrating an example of the ink jet recording head according to this embodiment.

An example of the ink jet recording head according to an embodiment of the present invention is illustrated in FIGS. 1 and 2. In the ink jet recording head illustrated in FIGS. 1 and 2, an energy generating element 1 is provided on a substrate 2. The substrate 2 can be a silicon substrate. On the substrate 2 and the energy generating element 1, a film 10 which is a protection film for protecting the energy generating element 1 and the like is provided. On the substrate 2, a flow path forming member 3 having a flow path 25 of ink formed between the substrate 2 and itself and having an ejection orifice 4 for ink at a position faced with the energy generating element 1 is provided. In the substrate 2, a supply path 5 of ink communicating with the flow path 25 and penetrating the substrate 2 is formed. The flow path forming member 3 has a structure 15 having a curved-surface shaped peripheral shape of a distal end portion protruding from a surface in contact with the flow path 25 and faced with the substrate 2 toward the supply path 5. The distal end portion of the structure 15 is located substantially on the same plane as the film 10. Moreover, from a viewpoint of suppression on a shape change of the flow path forming member 3, the flow path forming member 3 has a beam-shaped structure 21 formed substantially in parallel with an ejection orifice array made of a plurality of the ejection orifices 4 separately from the structure 15 and protruding from the surface in contact with the flow path 25 and faced with the substrate 2 toward the supply path 5. Since the peripheral shape of the distal end portion of the beam-shaped structure 21 has a corner part, it is not applicable to the structure 15 according to the present invention. Moreover, the flow path forming member 3 has a flow path structure 23 which is a support of the flow path 25 which is a cavity formed between the flow path forming member 3 and the substrate 2. The ink supplied from the supply path 5 to the flow path 25 is given energy such as a heat by the energy generating element 1 and ejected from the ejection orifice 4 to a recording medium, and image formation is performed.

In FIGS. 1 and 2, the structure 15 has a columnar shape, but the shape of the structure 15 is not particularly limited as long as the peripheral shape of the distal end portion of the structure 15 is a curved surface shape in the present invention. That is, the peripheral shape of the distal end portion of the structure 15 only needs not to have a corner part and may have a corner part on a side surface excluding the distal end portion of the structure 15, for example. The peripheral shape of the distal end portion of the structure 15 may be circular or elliptic, for example, or may be a shape obtained by chamfering a corner part of a polygon such as a square, a pentagon and the like. However, from a viewpoint that the crack in the membrane film can be sufficiently suppressed, the distal end portion of the structure 15 has preferably a substantially columnar shape.

If the distal end portion of the structure 15 has a substantially columnar shape, a diameter of a section of the distal end portion of the structure 15 in a surface substantially in parallel with the substrate 2 is preferably 3 μm or more to 20 μm or less. Since the diameter is 3 μm or more, a radius of curvature can be made larger, and a crack in the membrane film can be sufficiently suppressed. Moreover, since the diameter is 20 μm or less, the area of the supply path 5 opening portion can be ensured more sufficiently. The diameter is more preferably 4 μm or more to 17 μm or less and further preferably 5 μm or more to 15 μm or less.

The peripheral shape of the distal end portion of the structure 15 is a curved surface shape, but a radius of curvature (R) of the curved surface shape is preferably 1.5 μm or more, since a crack in the membrane film can be sufficiently suppressed. The radius of curvature (R) is more preferably 2 μm or more to 10 μm or less and further preferably 2.5 μm or more to 7.5 μm or less.

The number of structures 15 is not particularly limited, but in order to suppress a crack in the membrane film more sufficiently, one or more structures 15 are preferably disposed per ejection orifice of an ejection orifice array, in the ink jet recording head illustrated in FIGS. 1 and 2, for example, the one structure 15 is disposed per ejection orifice 4 of the ejection orifice array on the opening portion of the supply path 5 and between a side wall of the flow path 25 and the beam-shaped structure 21. Two or more structures 15 are more preferably disposed per ejection orifice 4 of the ejection orifice array and three or more are further preferably disposed.

Figure 7:
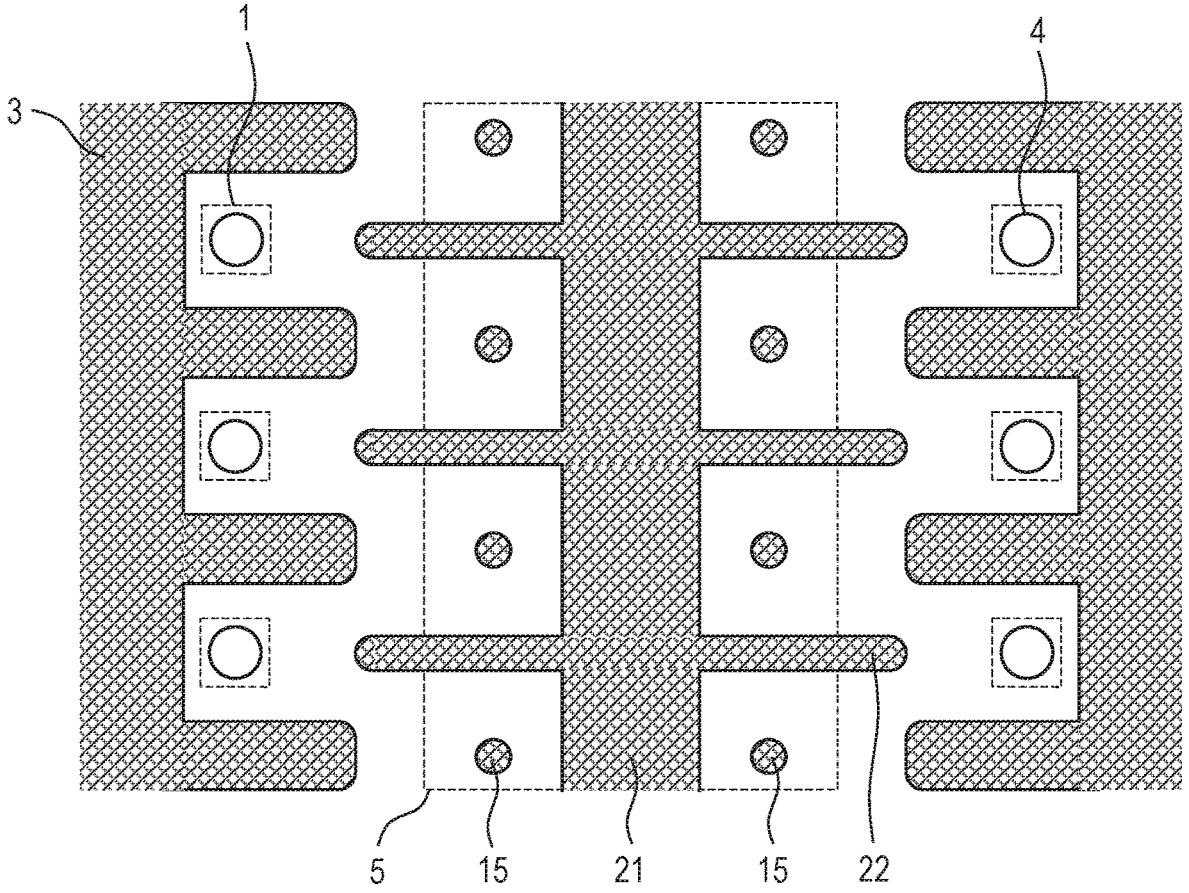
FIG. 7 is a plan view illustrating an example of the ink jet recording head in an example 3.
Figure 8:
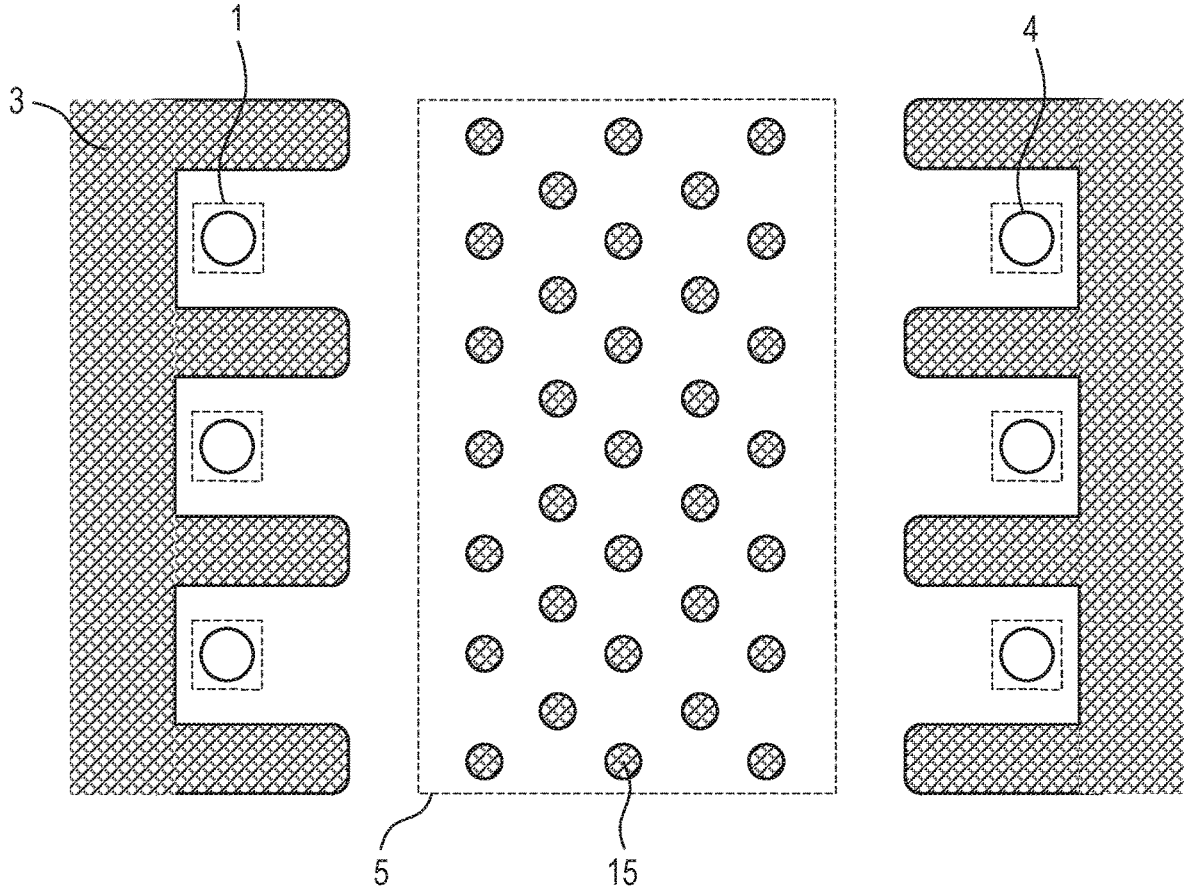
FIG. 8 is a plan view illustrating an example of the ink jet recording head in an example 5.

In the ink jet recording head illustrated in FIGS. 1 and 2, the flow path forming member 3 has the beam-shaped structure 21 separately from the structure 15, but as illustrated in FIG. 7, from a viewpoint of suppression of a shape change of the flow path forming member 3, the flow path forming member 3 may further have a rib-shaped structure 22. The rib-shaped structure 22 is formed substantially perpendicularly to the ejection orifice array formed of a plurality of the ejection orifices 4 and is formed so as to protrude from the surface in contact with the flow path 25 of the flow path forming member 3 and faced with the substrate 2 toward the supply path 5. In the ink jet recording head illustrated in FIG. 7, the structure 15 is formed on the opening portion of the supply path 5 and in a space surrounded by the beam-shaped structure 21 and the rib-shaped structure 22. Since the peripheral shape of the distal end portion of the rib-shaped structure 22 has a corner part, it is not applicable to the structure 15 according to the present invention. Moreover, the flow path forming member 3 may have the rib-shaped structure 22 without having the beam-shaped structure 21. Moreover, as illustrated in FIG. 8, the structures 15 may be disposed uniformly on the opening portion of the supply path 5 without having the beam-shaped structure 21 and the rib-shaped structure 22.

A compression stress of the film 10 in the present invention is preferably 200 MPa or more to 500 MPa or less. Since the compression stress of the film 10 is 200 MPa or more to 500 MPa or less, the film can have a fine film quality and can sufficiently function as an etching stop layer. A range of the compression stress of the film 10 is more preferably 250 MPa or more to 450 MPa or less.

A material of the film 10 is not particularly limited, but from a viewpoint of sufficient functioning as the etching stop layer in etching of the substrate 2, the film 10 is preferably a silicon oxide film or a silicon nitride film.

[Manufacturing Method of Liquid Ejection Head]

A manufacturing method of the liquid ejection head according to the present invention has the following processes. A process of forming a film on a substrate on which an energy generating element is provided. A process of forming a mold material of a flow path on the film. A process of forming a resin layer which becomes a flow path forming member having a structure on the film and the mold material. A process of forming an ejection orifice in the resin layer. A process of etching the substrate from a surface on a side opposite to a surface on which the film is formed by using the film as an etching stop layer. A process of removing the film present between an opening portion formed by the etching and the mold material along with the resin layer to form a supply path. A process of removing the mold material to form the flow path forming member having a flow path and the structure. According to the method according to the present invention, since a crack in the membrane film remaining after the etching of the substrate can be suppressed, a highly reliable liquid ejection head can be manufactured. Moreover, the liquid ejection head obtained by the method has an area of a supply path opening portion sufficiently ensured. In the following, the manufacturing method of the ink jet recording head according to an embodiment of the present invention will be described by referring to the drawings, but the present invention is not limited to them.

Figure 3A:
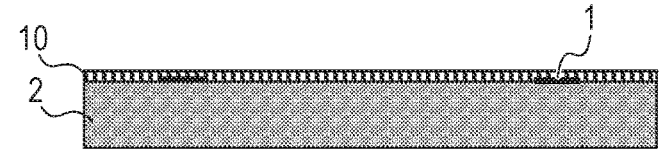
FIG. 3A is a sectional view illustrating an example of a manufacturing method of the ink jet recording head according to this embodiment.
Figure 3B:
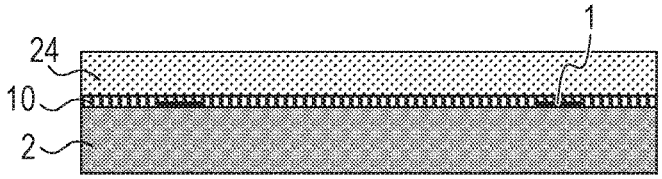
FIG. 3B is a sectional view illustrating an example of the manufacturing method of the ink jet recording head according to this embodiment.
Figure 3C:
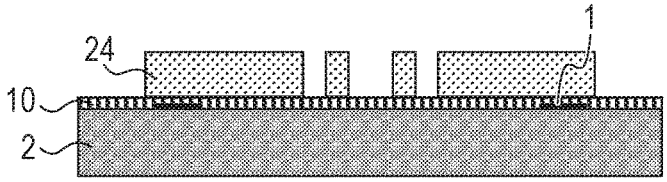
FIG. 3C is a sectional view illustrating an example of the manufacturing method of the ink jet recording head according to this embodiment.

An example of the manufacturing method of the ink jet recording head according to an embodiment of the present invention will be described in FIGS. 3A to 3H. First, as illustrated in FIG. 3A, on the substrate 2 made of silicon on which a semiconductor element, the energy generating element 1 and the like are provided, the film 10 functioning as a protective film and an etching stop layer is formed. The film 10 may be a silicon oxide film or a silicon nitride film and can be formed by plasma CVD, for example. A thickness of the film 10 can be 100 to 500 nm, for example. Subsequently, as illustrated in FIG. 3B, a layer 24 which becomes a mold material of a flow path is formed on the film 10. As a material of the layer 24, a dissolvable resin can be used, and polymethylisopropenylketone or the like can be used, for example. The layer 24 can be formed by laminating of a dry film, application by spin coating and the like, for example. Subsequently, as illustrated in FIG. 3C, the mold material 24 of the flow path is formed by exposing, developing and patterning the layer 24. The exposure includes exposure by ultraviolet rays (Deep-UV light), for example.

Figure 3D:
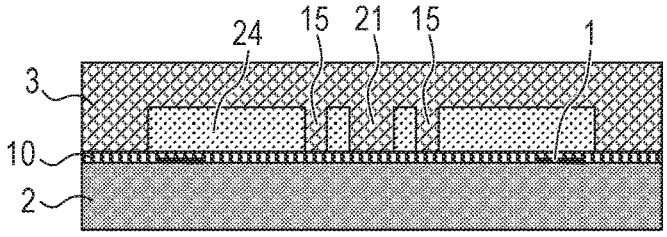
FIG. 3D is a sectional view illustrating an example of the manufacturing method of the ink jet recording head according to this embodiment.
Figure 3E:
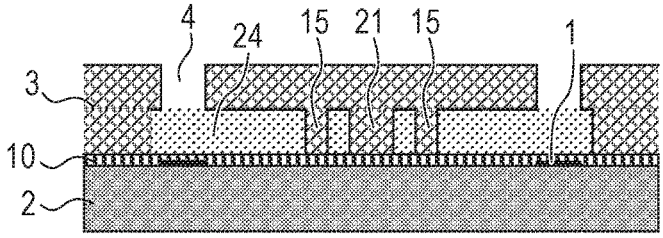
FIG. 3E is a sectional view illustrating an example of the manufacturing method of the ink jet recording head according to this embodiment.

Subsequently, as illustrated in FIG. 3D, on the film 10 and the mold material 24, the resin layer 3 which is to be turned into the flow path forming member 3 having the structure 15 and the beam-shaped structure 21 according to the present invention is formed. As a material of the resin layer 3, an epoxy resin or the like can be used, for example. The resin layer 3 can be formed by application by spin coating or the like, for example. Subsequently, as illustrated in FIG. 3E, the ejection orifice 4 is formed in the resin layer 3. The formation of the ejection orifice 4 can be performed by exposure of ultraviolet rays (Deep-UV light) or the like and development, for example.

Figure 3F:
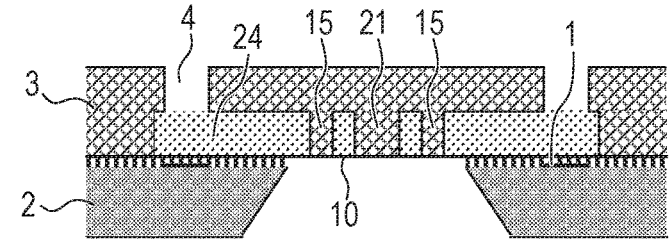
FIG. 3F is a sectional view illustrating an example of the manufacturing method of the ink jet recording head according to this embodiment.

Subsequently, as illustrated in FIG. 3F, the substrate 2 is etched from the surface on the side opposite to the surface on which the film 10 is formed by using the film 10 as the etching stop layer. The etching can be wet-etching and is preferably anisotropic etching by strong alkaline solution such as KOH, NaOH, TMAH (tetramethylammonium hydroxide). After the etching, the membrane film 10 present in the opening portion formed by the etching does not have support any more by the substrate 2. This membrane film 10 is in contact with the mold material 24 and the resin layer 3, but the mold material 24 has been softened by heating during the etching, and the membrane film 10 is supported only by a portion 21 which becomes the beam-shaped structure of the resin layer 3 and a portion 15 which becomes the structure according to the present invention. Here, in the method according to the present invention, since the bending angle of the membrane film 10 can be reduced by the presence of the portion 15 which becomes the structure, the bending angle can be prevented from reaching the limit bending angle, and a crack in the membrane film 10 can be suppressed. Moreover, the peripheral shape of the distal end portion of the portion 15 which becomes the structure is a curved surface shape and does not have a corner part and thus, even if the membrane film 10 is bent/deformed, occurrence of stress concentration on the corner part can be suppressed, and a crack in the membrane film 10 can be suppressed.

Figure 3G:
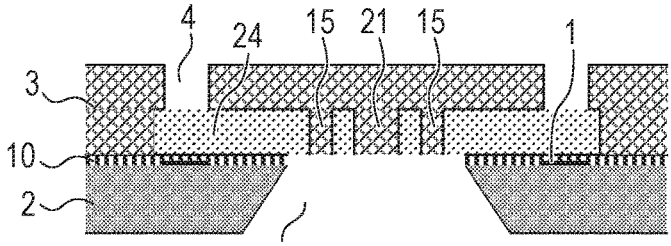
FIG. 3G is a sectional view illustrating an example of the manufacturing method of the ink jet recording head according to this embodiment.
Figure 3H:
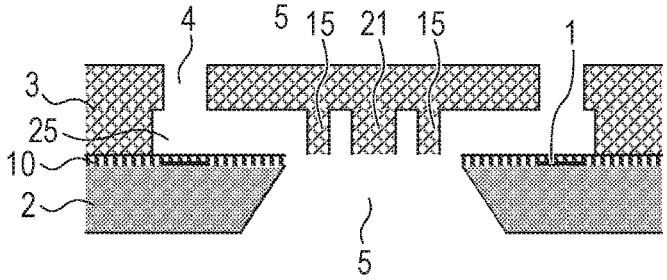
FIG. 3H is a sectional view illustrating an example of the manufacturing method of the ink jet recording head according to this embodiment.

Subsequently, as illustrated in FIG. 3G, the membrane film 10 is removed, and the supply path 5 is formed. The removal of the membrane film 10 can be performed by plasma etching or the like. Subsequently, as illustrated in FIG. 3H, the mold material 24 is removed, and the flow path forming member 3 having the hollow flow path 25, the structure 15, and the beam-shaped structure 21 is formed. The mold material 24 can be removed by being dissolved in a solvent, for example.

As described above, the ink jet recording head is completed. In the method according to this embodiment, since a crack in the membrane film can be suppressed by the structure according to the present invention, the highly reliable ink jet recording head can be manufactured. Moreover, the ink jet recording head in which the area of the supply path opening portion is sufficiently ensured can be manufactured.

EXAMPLE

Hereinafter, embodiments according to the present invention will be described in more detail by using examples and a comparative example. The present invention is not limited by the following examples as long as a gist thereof is not departed.

Example 1

The ink jet recording head illustrated in FIGS. 1 and 2 was manufactured by the method illustrated in FIGS. 3A to 3H. First, as illustrated in FIG. 3A, the film 10 was formed on the substrate 2 made of silicon having a thickness 725 μm on which the semiconductor element and the energy generating element 1 were provided. The film 10 was a silicon nitride film and was formed by plasma CVD. A thickness of the film 10 was 300 nm, and the compression stress was 500 MPa. Subsequently, as illustrated in FIG. 3B, the layer 24 which becomes the mold material of the flow path was formed on the film 10. The layer 24 was formed by spin-coating polymethylisopropenylketone (product name: ODUR-1010, by Tokyo Ohka Kogyo Co., Ltd.) so that the thickness became 20 μm. Subsequently, as illustrated in FIG. 3C, the layer 24 was exposed to ultraviolet rays (Deep-UV light) and developed and then, patterned so as to form the mold material 24 of the flow path.

Subsequently, as illustrated in FIG. 3D, on the film 10 and the mold material 24, the resin layer 3 which is to be turned into the flow path forming member 3 having the structure 15 and the beam-shaped structure 21 according to the present invention was formed. Specifically, a negative type photosensitive resin composition having the following composition was applied and pre-baked so as to form the resin layer 3. A height (a thickness of the resin layer 3) of the resin layer 3 from the film 10 was 75 μm.

| | |
|---|---|
| EHPE (product name, by Daicel Corporation) | 100 mass parts |
| SP-172 (product name, by ADEKA Corporation) | 5 mass parts |
| A-187 (product name, by Dow Corning Toray Co., Ltd.) | 5 mass parts |
| Methylisobutylketone | 100 mass parts |

Subsequently, as illustrated in FIG. 3E, the resin layer 3 was exposed to ultraviolet rays (Deep-UV light) and developed so as to form the ejection orifices 4 at an interval of 80 μm. Subsequently, as illustrated in FIG. 3F, the substrate 2 was subjected to wet-etching from a back surface side of the substrate 2 with the film 10 as the etching stop layer, and the supply path opening portion having an opening width of 150 μm was formed. At this time, the membrane film 10 was in an exposed state in the supply path opening portion. However, since the membrane film 10 was supported by the portion 15 which became the structures according to the present invention disposed uniformly in the supply path opening portion, the bending angle of the membrane film 10 was 2.6° and did not reach the limit bending angle (3.0°). As a result, a crack did not occur in the membrane film 10. The bending angle and the limit bending angle were measured by the following method. The membrane film 10 surface was measured by using a 3D optical surface profiler of a white light interferometer type, and a deformation height was extracted from the obtained membrane surface information. The bending angle and the limit bending angle were calculated from a sectional area (width) and the deformation height of the membrane film 10.

Subsequently, as illustrated in FIG. 3G, the membrane film 10 exposed in the supply path opening portion was removed by plasma etching, and the supply path 5 was formed. Subsequently, as illustrated in FIG. 3H, the mold material 24 was dissolved in the solvent and removed, and the flow path forming member 3 having the flow path 25 and the columnar structure 15 with the diameter of 10 μm and the beam-shaped structure 21 with a width of 50 μm was formed. The structure 15 was disposed one per ejection orifice 4.

As described above, the ink jet recording head was completed. In this example, since a crack in the membrane film 10 did not occur after the wet-etching, a highly reliable ink jet recording head was obtained. Moreover, an area (area A corresponding to the comparative example 1 which will be described later) of the supply path opening portion per ejection orifice 4 when there is no structure 15 illustrated in FIG. 5 and an area (area B) of the supply path opening portion per ejection orifice 4 when there is the structure 15 in this example were calculated. A result obtained by calculating an area ratio (area B/area A) between the area A and the area B is shown in Table 1. The area ratio was 0.96 in the example, and an area decrease rate of the supply path opening portion by the presence of the structure 15 was 10% or less. Therefore, the area of the supply path opening portion was sufficiently ensured in the ink jet recording head.

Example 2

The ink jet recording head was manufactured similarly to Example 1 except that the compression stress of the film 10 was changed to 200 MPa. After the wet-etching, the bending angle of the exposed membrane film 10 was 2.3° and did not reach the limit bending angle (3.0°). As a result, a crack did not occur in the membrane film 10, and a highly reliable ink jet recording head was obtained. Moreover, the area ratio was 0.96 as shown in Table 1, and the area decrease rate of the supply path opening portion by the presence of the structure 15 was 10% or less. Therefore, in the ink jet recording head, the area of the supply path opening portion was sufficiently ensured.

Example 3

As illustrated in FIG. 7, the ink jet recording head was manufactured similarly to Example 1 except that the width of the beam-shaped structure 21 was changed to 40 μm and the flow path forming member 3 was changed to further have the rib-shaped structure 22 with the width of 10 μm. Here, the structure 15 was disposed one in a region surrounded by the beam-shaped structure 21 and the rib-shaped structure 22 so as to uniformly divide the supply path opening portion.

After the wet-etching, the bending angle of the exposed membrane film 10 was 2.7° and did not reach the limit bending angle (3.0°). As a result, a crack did not occur in the membrane film 10, and a highly reliable ink jet recording head was obtained. Moreover, the area ratio was 0.94 as shown in Table 1, and the area decrease rate of the supply path opening portion by the presence of the structure 15 was 10% or less. Therefore, in the ink jet recording head, the area of the supply path opening portion was sufficiently ensured. If the beam-shaped structure 21 and the rib-shaped structure 22 are present as in this example, the flow path is closed, and it is difficult to dispose more rib-shaped structures 22 than this. In such a case, too, the structure according to the present invention can be disposed without closing the flow path.

Example 4

The ink jet recording head was manufactured similarly to Example 3 except that the compression stress of the film 10 was changed to 200 MPa. After the wet-etching, the bending angle of the exposed membrane film 10 was 2.3° and did not reach the limit bending angle (3.0°). As a result, a crack did not occur in the membrane film 10, and a highly reliable ink jet recording head was obtained. Moreover, the area ratio was 0.94 as shown in Table 1, and the area decrease rate of the supply path opening portion by the presence of the structure 15 was 10% or less. Therefore, in the ink jet recording head, the area of the supply path opening portion was sufficiently ensured.

Example 5

As illustrated in FIG. 8, the ink jet recording head was manufactured similarly to Example 2 except that the beam-shaped structure 21 was eliminated, and the columnar structure 15 having the diameter of 3 μm was disposed in 5.5 pieces per ejection orifice 4 so as to uniformly divide the supply path opening portion.

After the wet-etching, the bending angle of the exposed membrane film 10 was 2.7° and did not reach the limit bending angle (3.0°). As a result, a crack did not occur in the membrane film 10, and a highly reliable ink jet recording head was obtained. Moreover, the area ratio was 1.49 as shown in Table 1, and since the beam-shaped structure 21 was eliminated, the area of the supply path opening portion larger than the ordinary could be ensured. By eliminating the beam-shaped structure 21 and the rib-shaped structure 22 as in this example, a degree of disposition freedom of the structure according to the present invention is improved.

Example 6

The ink jet recording head was manufactured similarly to Example 5 except that the diameter of the columnar structure 15 was changed to 10 μm. After the wet-etching, the bending angle of the exposed membrane film 10 was 2.4° and did not reach the limit bending angle (3.0°). As a result, a crack did not occur in the membrane film 10, and a highly reliable ink jet recording head was obtained. Moreover, the area ratio was 1.39 as shown in Table 1, and since the beam-shaped structure 21 was eliminated, the area of the supply path opening portion larger than the ordinary could be ensured.

Example 7

The ink jet recording head was manufactured similarly to Example 5 except that the diameter of the columnar structure 15 was changed to 20 μm. After the wet-etching, the bending angle of the exposed membrane film 10 was 2.0° and did not reach the limit bending angle (3.0°). As a result, a crack did not occur in the membrane film 10, and a highly reliable ink jet recording head was obtained. Moreover, the area ratio was 1.07 as shown in Table 1, and since the beam-shaped structure 21 was eliminated, the area of the supply path opening portion larger than the ordinary could be ensured.

Comparative Example 1

Figure 5:
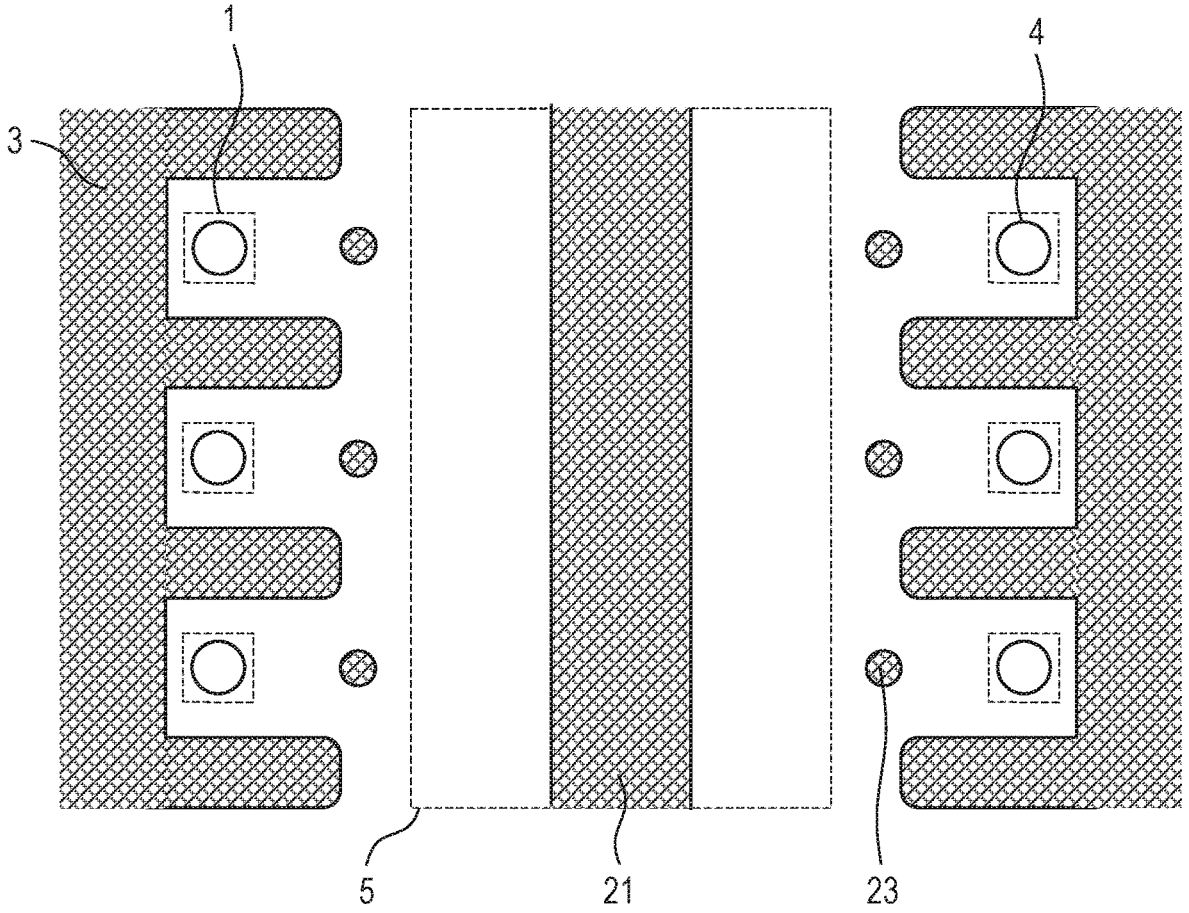
FIG. 5 is a plan view illustrating an example of the ink jet recording head in a comparative example 1.

As illustrated in FIG. 5, the ink jet recording head was manufactured similarly to Example 1 except that the structure 15 was not provided. After the wet-etching, the bending angle of the exposed membrane film 10 was 3.0° and reached the limit bending angle (3.0°) and thus, a crack in the membrane film 10 occurred, and a highly reliable ink jet recording head could not be obtained.

Comparative Example 2

The ink jet recording head was manufactured similarly to Example 1 except that the shape of the structure 15 was changed to a quadrangular prism shape. Since the peripheral shape of the distal end portion of the structure 15 was not a curved surface shape but had a corner part, stress concentration occurred on the corner part after the wet-etching, and a crack in the membrane film 10 occurred. As a result, a highly reliable ink jet recording head could not be obtained. This stress concentration phenomenon occurred only on the corner part and did not occur on an end surface of a side or a curved surface end surface.

TABLE 1

| | Compression stress of film (MPa) | Diameter of structure (μm) | Bending angle of membrane film (°) | Crack in membrane film | Area A ($\mu m^2$) | Area ratio (area B/area A) |
|---|---|---|---|---|---|---|
| Example 1 | 500 | 10 | 2.6 | NO | 3850 | 0.96 |
| Example 2 | 200 | 10 | 2.3 | NO | 3850 | 0.96 |
| Example 3 | 500 | 10 | 2.7 | NO | 3772 | 0.94 |
| Example 4 | 200 | 10 | 2.3 | NO | 3772 | 0.94 |
| Example 5 | 200 | 3 | 2.7 | NO | 5961 | 1.49 |

TABLE 1-continued

| | Compression stress of film (MPa) | Diameter of structure (μm) | Bending angle of membrane film (°) | Crack in membrane film | Area A ($\mu m^2$) | Area ratio (area B/area A) |
|---|---|---|---|---|---|---|
| Example 6 | 200 | 10 | 2.4 | NO | 5568 | 1.39 |
| Example 7 | 200 | 20 | 2.0 | NO | 4273 | 1.07 |
| Comparative Example 1 | 500 | — | 3.0 | YES | 4000 | 1.00 |
| Comparative Example 2 | 200 | —(Quadrangular prism) | 3.1 | YES | 3850 | 0.96 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-005760, filed Jan. 17, 2018, which is hereby incorporated by reference herein in its entirety.

What is claimed is:

1. A liquid ejection head comprising:

a substrate;

an energy generating element provided on the substrate;

a film provided on the substrate and the energy generating element; and a flow path forming member provided on the substrate, forming a flow path of a liquid between the flow path forming member and the substrate and having an ejection orifice at a position faced with the energy generating element, wherein:

the substrate has a supply path for a liquid communicating with the flow path;

the flow path forming member has a structure protruding toward the supply path;

a peripheral shape of a distal end portion of the structure is a curved surface shape;

the distal end portion of the structure has a substantially columnar shape; and a diameter of a section in a surface substantially in parallel with the substrate of the distal end portion of the structure is 3 μm to 20 μm.

2. The liquid ejection head according to claim 1, wherein the distal end portion of the structure is located substantially on the same plane as the film.

3. The liquid ejection head according to claim 1, wherein compression stress of the film is 200 MPa to 500 MPa.

4. The liquid ejection head according to claim 1, wherein the film is a silicon oxide film or a silicon nitride film.

5. A liquid ejection head comprising:

a substrate;

an energy generating element provided on the substrate;

a film provided on the substrate and the energy generating element; and a flow path forming member provided on the substrate, forming a flow path of a liquid between the flow path forming member and the substrate and having an ejection orifice at a position faced with the energy generating element, wherein:

the substrate has a supply path for a liquid communicating with the flow path;

the flow path forming member has a structure protruding toward the supply path;

a peripheral shape of a distal end portion of the structure is a curved surface shape; and a radius of curvature (R) of the curved surface shape is 1.5 μm or more.

6. A liquid ejection head comprising:

a substrate;

an energy generating element provided on the substrate;

a film provided on the substrate and the energy generating element; and a flow path forming member provided on the substrate, forming a flow path of a liquid between the flow path forming member and the substrate and having an ejection orifice at a position faced with the energy generating element, wherein:

the substrate has a supply path for a liquid communicating with the flow path;

the flow path forming member has a structure protruding toward the supply path;

a peripheral shape of a distal end portion of the structure is a curved surface shape;

the flow path forming member has an ejection orifice array made of a plurality of the ejection orifices; and at least one said structure is disposed per ejection orifice of the ejection orifice array.

7. The liquid ejection head according to claim 6, wherein the flow path forming member further has a beam-shaped structure formed substantially in parallel with the ejection orifice array and protruding toward the supply path.

8. The liquid ejection head according to claim 6, wherein the flow path forming member further has a rib-shaped structure formed substantially perpendicularly to the ejection orifice array and protruding toward the supply path.

* * * * *